United States Patent [19]

Iwata

[11] 4,312,311

[45] Jan. 26, 1982

[54] ENGINE IDLING CORRECTION SYSTEM FOR AN AUTOMOTIVE VEHICLE

[75] Inventor: Hiroyoshi Iwata, Yachiyo, Japan

[73] Assignee: Nissan Motor Company, Limited, Yokohama, Japan

[21] Appl. No.: 145,988

[22] Filed: May 2, 1980

[30] Foreign Application Priority Data

May 2, 1979 [JP] Japan ..... 54-59297[U]

[51] Int. Cl.[3] ..... F02M 3/00

[52] U.S. Cl. ..... 123/339; 62/243; 74/873; 123/198 R; 180/54 G

[58] Field of Search ..... 123/339, 368, 195 A, 123/198 R; 180/54 G; 74/873, 872; 62/215, 243, 323

[56] References Cited

U.S. PATENT DOCUMENTS

| | | | |
|---|---|---|---|
| 2,913,921 | 11/1959 | Gordon | 123/339 X |
| 2,929,226 | 3/1960 | Baker et al. | 123/339 X |
| 3,103,128 | 9/1963 | Gordon | 123/339 X |
| 3,146,845 | 9/1964 | Carlson | 123/339 X |
| 3,252,539 | 5/1966 | Ott et al. | 123/339 X |
| 3,253,772 | 5/1966 | Parker | 123/339 X |
| 4,182,291 | 1/1980 | Ito | 123/339 |
| 4,186,697 | 2/1980 | Yasuda et al. | 123/339 X |

FOREIGN PATENT DOCUMENTS

| | | | |
|---|---|---|---|
| 54-17429 | 2/1979 | Japan | 123/339 |
| 54-150522 | 11/1979 | Japan | 123/339 |
| 54-155317 | 12/1979 | Japan | 123/339 |
| 55-5437 | 1/1980 | Japan | 123/339 |

*Primary Examiner*—Wendell E. Burns

*Attorney, Agent, or Firm*—Schwartz, Jeffery, Schwaab, Mack, Blumenthal & Koch

[57] ABSTRACT

An engine idling correction system for an automotive vehicle provided with an air conditioner and an automatic transmission comprises a novel actuator having two vacuum compartments. A vacuum supplied from an intake vacuum outlet on an intake manifold of the engine is introduced into a first vacuum compartment in the actuator when a thermostat provided in the cooling unit is turned on, and into a second vacuum compartment in the same actuator when a neutral switch provided for the automatic transmission is turned on, whether independently or simultaneously, in order to open the throttle valve; that is, to correct the engine revolution speed under engine idling conditions. The actuator thus improved is also so designed as to be adaptable to engine idling correction systems for various automotive vehicles, with less costly structure and better interchangeability.

5 Claims, 2 Drawing Figures

ENGINE IDLING CORRECTION SYSTEM FOR AN AUTOMOTIVE VEHICLE

BACKGROUND OF THE INVENTION

1. Field of the Invention

The present invention relates generally to an engine idling correction system for an automotive vehicle having an air conditioner and an automatic transmission, and more particularly to an actuator provided for the system, in which two vacuum compartments are arranged so as to open the throttle valve; that is, so as to increase the engine revolution speed under engine idling conditions, independently or simultaneously, whenever a thermostat or a neutral switch is turned on.

2. Description of the Prior Art

Generally, if an air conditioner is turned on while the engine is idling, the engine speed is lowered. This is because an increase in engine load due to a compressor provided for the air conditioner will lower the engine speed under engine idling conditions. Therefore, it is necessary to correct, or raise, the engine speed.

In addition, in the case of an automotive vehicle provided with an automatic transmission, there are many cases where the vehicle is left parked with the shift lever set to L(Low) or D(Drive) position. In this case, since an increase in engine load due to the automatic transmission will further lower the engine speed, if both the load due to the air conditioner and the automatic transmission are applied to the engine at the same time, a conventional engine idling correction system for correcting only a drop in engine speed due to the air conditioner cannot control the lowering of the engine speed. As a result, the engine may cause vibration or deterioration in cooling performance within the passenger compartment, and thereby the passengers may feel discomfort.

To cope with this problem, two separate actuators or a two-stage operation-type actuator has generally been used for correcting a decrease in engine speed caused by both the loads of the air conditioner and the automatic transmission.

However, in the case of the two-stage operation type actuator, since this actuator is required to determine the priority order of operation start and end, it is necessary to provide an additional control unit for controlling an vacuum circuit to activate the actuator in order. On the other hand, in the case of two separate actuators, the system is more complicated.

In any case, since such a system is inevitably costly, there has been a need for a more simple, less costly actuator mounted in an automotive vehicle having an automatic transmission and an air conditioner.

SUMMARY OF THE INVENTION

With these problems in mind, therefore, it is the primary object of the present invention to provide an actuator used for an engine idling correction system which can independently cope with both the loads caused by the automatic transmission and the air conditioner, without need for any additional vacuum controlling unit, so that the engine can always be kept at an appropriate rotation speed under idling conditions.

It is another object of the present invention to provide an actuator used for an engine idling correction system which is less costly.

It is a further object of the present invention to provide an actuator used for an engine idling correction system which is adaptable in size and mounting method to various automotive vehicles.

With the above and other objects in view, the present invention provides an actuator used for an engine idling correction system for an air conditioner mounted on an automotive vehicle having an automatic transmission, which comprises a first vacuum compartment formed by a first diaphragm and a second vacuum compartment formed by a second diaphragm. An intake vacuum produced when the air conditioner is operating is introduced into the first vacuum compartment to shift a shaft connected to a throttle valve, so that the engine speed is raised. The intake vacuum produced when the automatic transmission affects the engine speed is introduced to the second vacuum compartment to shift a collar slidably fitted to the shaft. Although the shaft can move leaving the slidable collar as it is, when the slidable collar comes into contact with a locking washer fixed to an end of the shaft, the slidable collar can shift the shaft to open the throttle valve, so that the engine speed is also indirectly raised by the slidable collar. Accordingly, the actuator of the present invention can control the engine speed, in accordance with the signal produced when the air conditioner is operating or when the automatic transmission exerts influence on the engine speed independently or simultaneously.

The above and other related objects and features of the present invention will be apparent from the following description of the disclosure illustrated by the accompanying drawings and the novelty thereof pointed out in the appended claims.

BRIEF DESCRIPTION OF THE DRAWINGS

The features and advantages of the present invention over prior-art engine idling correction system for automotive vehicles will be more clearly appreciated from the following description of a preferred embodiment, taken in conjunction with the accompanying drawings, all of which are given for purpose of explanation only and are not intended to be limiting of the scope of the invention, and in which like reference characters designate the same or similar parts throughout the figures and wherein.

DETAILED DESCRIPTION OF THE PREFERRED EMBODIMENT

Figure 1:
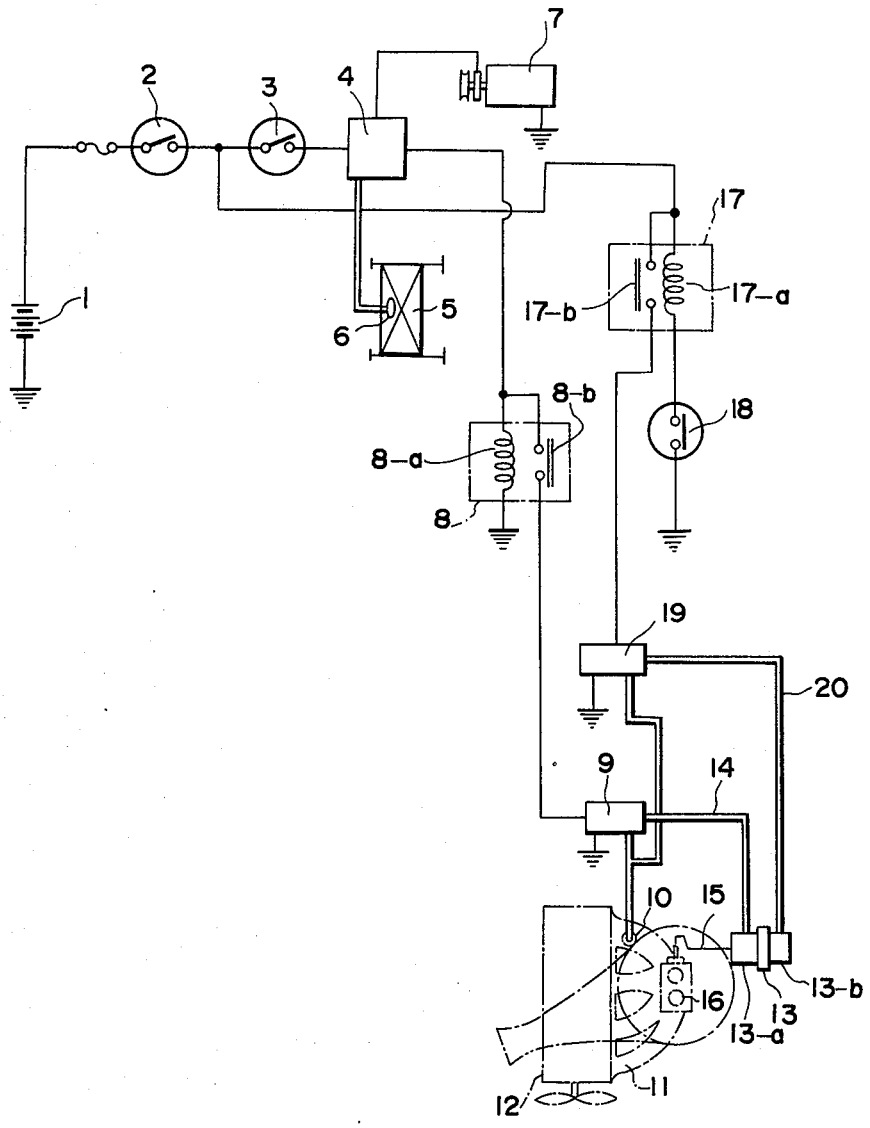
FIG. 1 is a schematic illustration of an embodiment of the present invention.

In FIG. 1 is illustrated schematically a preferred embodiment of the present invention.

In FIG. 1, the engine-idling correction system is provided with a power supply 1, an ignition switch 2, and an air conditioner switch 3.

If the ignition switch 2 and the air conditioner switch 3 are both turned on, the air conditioner system begins to operate. In this case, if a thermostat 4 is turned on by a temperature sensor 6 detecting an air temperature within a cooling unit 5 below a certain value, a compressor 7 begins to operate to cool the air in the passenger compartment. At the same time, power is supplied to a coil 8-*a* of a first relay 8, and thereby a contact 8-*b* is closed to activate a first electromagnetic valve 9. As a result, a vacuum is introduced from an intake vacuum outlet 10 on an intake manifold 11 of an engine 12 to a first vacuum compartment 13-*a* of an actuator 13 through a first vacuum passage 14 and moves a shaft 15. Since the shaft 15 is connected to a throttle valve (not shown) in a carburetor 16, the engine speed of the engine 12 is thereby increased to a certain predetermined value.

If the ignition switch 2 is turned on, power is supplied to a coil 17-*a* of a second relay 17 only when a neutral switch 18 is on. This neutral switch 18 is so designed as to be turned on when the shift lever (not shown) is set to positions other than P(parking) and N(neutral); that is, in this case, by way of example, to L(low), D(drive) or R(reverse). Accordingly, if the shift lever is at L, D, or R, power is supplied to the coil 17-*a* and thereby a contact 17-*b* is closed to activate a second electromagnetic valve 19. As a result, a vacuum is also introduced from the inlet vacuum outlet 10 to a second vacuum compartment 13-*b* of the actuator 13 through a second vacuum passage 20 and moves the shaft 15. In the same way as in the air conditioner system, since the shaft 15 is connected to the throttle valve in the carburetor 16, the speed of the engine 12 is also increased to a desired value.

Figure 2:
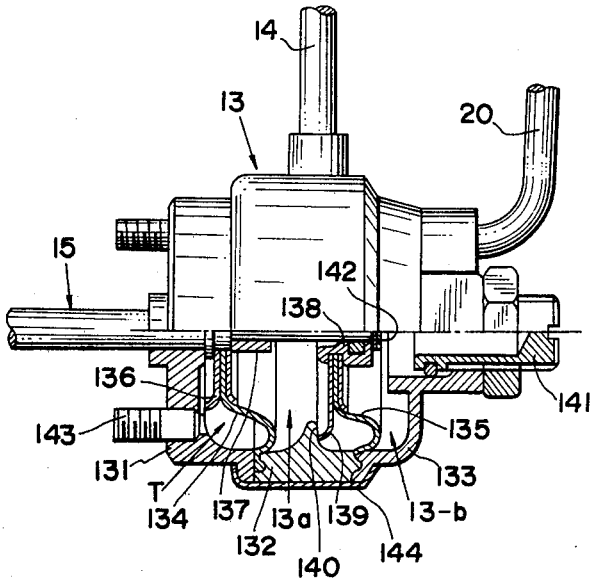
FIG. 2 is a vertical, partial sectional view of the structure of one actuator embodying the invention.

FIG. 2 shows in detail the structure of the actuator 13 including the first vacuum compartment 13-*a* and the second vacuum compartment 13-*b*.

In FIG. 2, the actuator 13 has a housing in three parts 131, 132, and 133. In this housing, the first vacuum compartment 13-*a* is formed by a first annular diaphragm 134; the second vacuum compartment 13-*b* is formed by a second annular diaphragm 135.

In addition, the first vacuum passage 14 communicates with the first vacuum compartment 13-*a*; the second vacuum passage 20 communicates with the second vacuum compartment 13-*b*.

The inner periphery of the first diaphragm 134 is fixed to a shaft 15 at an intermediate position of the shaft 15, and the outer periphery of the first diaphragm 134 is fixed to the housing portion 132. A first guide disk 136 which is in contact with the first diaphragm 134 and also fixed to the shaft 15 limits the leftward movement of the first diaphragm 134 when brought into contact with the housing portion 131, and a collar 137 fixed to the shaft 15 limits the rightward movement of the first diaphragm 134 when brought into contact with a slidable collar 138.

Next, the inner periphery of the second diaphragm 135 is fixed to the slidable collar and the outer periphery of the second diaphragm 135 is fixed to the housing portion 133. A second guide disk 139 which is in contact with the second diaphragm 135 and fixed to the slidable collar 138 limits the leftward movement of the second diaphragm 135 when brought into contact with a stopper portion 140 of the housing portion 132, and the slidable collar 138 slidably fitted to the shaft 15 limits the rightward movement of the second diaphragm 135 when brought into contact with an adjusting stop screw 141. A locking washer 142 is fitted to the shaft 15, so that the slidable bearing 138 can catch the locking washer 142 to move the shaft 15 rightward.

In addition, in this figure, numeral 143 denotes a bolt to fasten the actuator 13 to the engine, numeral 144 denotes a case cover, and the symbol T designates atmospheric pressure.

With the above-mentioned system, if the thermostat 4 is turned on to activate the cooling system, the electromagnetic valve 9 is opened by the relay 8 to introduce a vacuum to the first vacuum compartment 13-*a* of the actuator 13 through the first vacuum passage 14. In this case, since the second diaphragm 135 is shifted to the leftmost position and stopped by the second guide disk 139 against the stop portion 140 of the housing 132, only the first diagram 134 moves rightward to move the shaft 15 leaving the slidable collar 138 as it is.

Therefore, a throttle valve (not shown) is opened to increase the engine speed. The operation angle of this throttle valve is determined by the stroke of the first diaphragm 134 between the leftmost position where the first guide disk 136 is brought into contact with the housing 131 and the rightmost position where the collar 137 is brought into contact with the collar 138; therefore, it is possible to obtain a predetermined range for correcting a decrease in speed due to the load of the air conditioner by presetting an appropriate length of the stroke.

Similarly, if the shift lever of the automatic transmission is set to a position other than P(parking) and N(neutral); that is, to L(low), D(drive), or R(reverse), the neutral switch 18 in FIG. 1 is tured on, and the electromagnetic valve 19 is opened by the relay 17 to introduce a vacuum to the second vacuum compartment 13-*b* of the actuator 13 through the second vacuum passage 20. In this case, since the collar 138 comes in contact with the locking washer 142, the second diaphragm 135 moves the shaft 15 together with the first diaphragm 134 to open the throttle valve; therefore, a decrease in engine speed due to the load of the automatic transmission is corrected. In addition, it is possible to accurately obtain a correct range by adjusting the adjusting stop screw 141 which can limit the rightward movement of the slidable collar 138.

Moreover, if the thermostat 4 and the neutral switch 18 are both turned on, a vacuum is introduced to both of the first and second vacuum compartments 13-*a*, and 130*b*. In this case, since the second diaphragm 135 is moved to the position where the slidable collar 138 comes in contact with the adjusting stop screw 141 and the first diaphragm 134 is moved to the position where the fixed collar 137 comes in contact with the slidable collar 138, the shaft 15 is moved rightward by an amount corresponding to the sum of both movements of the first and second diaphragms 134 and 135. Accordingly, it is possible to accurately move the shaft 15, and thus the throttle valve, in order to correct for a decrease in engine speed under engine idling conditions due to the loads of the air conditioner and the torque converter.

As described above, having a simple, less costly and yet effective structure, the single actuator of the present invention can accurately correct a decrease in engine speed under engine idling conditions due to both the loads of the air conditioner and the automatic transmission both separately and together.

In addition, the actuator of the present invention is so designed as to be adaptable, in size and in mounting method, not only to an actuator used for a conventional engine idling correction system for an automotive vehicle having only an air conditioner but also may be used with an automotive vehicle of the mechanical transmission type; that is, as to be excellent in interchangeability.

It is further to be understood by those skilled in the art that the foregoing description is in terms of preferred embodiments of the present invention wherein various changes and modifications may be made without departing from the spirit and scope of the invention, as set forth in the appended claims.

What is claimed is:

1. In an engine idling correcting system for an automotive vehicle including an air conditioner and an automatic transmission, an actuator which comprises:

(a) a housing;

(b) an operating shaft disposed within said housing;

(c) a first diagram disposed within said housing and fixed to said operating shaft;

(d) a second diaphragm disposed within said housing so as to form a first vacuum compartment between said first and second diaphragms and a second vacuum compartment between said second diaphragm and a portion of said housing;

(e) a slidable collar fitted over said operating shaft and fixed to said second diaphragm;

(f) a locking washer provided on said operating shaft with which said slidable collar may engage to move said shaft;

(g) first switching means for selectively introducing a vacuum into the first vacuum compartment in response to a first parameter of the engine operating conditions; and (h) second switching means for selectively introducing a vacuum into the second vacuum compartment in response to a second parameter of the engine operating conditions, whereby if either switching means is activated to admit a vacuum, said operating shaft is moved.

2. The actuator of claim 1 further comprising:

(i) a fixed collar fixed in relation to said operating shaft in such a position that when the first vacuum compartment is evacuated, the travel of said operating shaft is limited by said fixed collar engaging the slidable collar, and whereby the travel of said operating shaft is greater when both said first and second switch means are activated to admit a vacuum than when either switch means is activated individually.

3. The actuator of claim 2 further comprising:

(j) a stop screw fixed in relation to said housing and adapted to limit the movement of said slidable collar when said second switching means is activated to supply a vacuum to the second vacuum compartment.

4. The actuator of claim 3 wherein said stop screw is adjustable.

5. The actuator of claim 2 or 3 wherein the travel of said operating shaft when both said switching means are activated is substantially equal to the sum of the travel when said first switching means only is activated and the travel when said second switching means only is activated.

* * * * *